US006327752B1

(12) United States Patent
Hinkey

(10) Patent No.: US 6,327,752 B1
(45) Date of Patent: Dec. 11, 2001

(54) CLAMPING DEVICE FOR SECURING A CABLE

(76) Inventor: Lawrence A. Hinkey, 22 Grove Ave., Glens Falls, NY (US) 12801

( * ) Notice: Subject to any disclaimer, the term of this patent is extended or adjusted under 35 U.S.C. 154(b) by 0 days.

(21) Appl. No.: 09/596,970

(22) Filed: Jun. 20, 2000

Related U.S. Application Data

(60) Provisional application No. 60/140,647, filed on Jun. 23, 1999.

(51) Int. Cl.[7] ..... E05B 73/00; A44B 21/00

(52) U.S. Cl. ..... 24/115 M; 24/71 TD; 24/68 CD; 70/18

(58) Field of Search ..... 24/115 M, 116 R, 24/129 R, 136 R, 71 TD, 71 CT, 69 TT, 68 CD, 69 R; 70/14, 18; 114/172

(56) References Cited

U.S. PATENT DOCUMENTS 1,377,413 * 5/1921 Dwelle ..... 70/18 X
3,426,996 * 2/1969 Broling ..... 24/71 TD
4,212,175 7/1980 Zakow .
5,181,402 * 1/1993 Faessler et al. ..... 70/18
5,187,840 * 2/1993 Kaczorowski ..... 24/68 CD X
6,163,935 * 12/2000 Hinkey ..... 24/71 TD

FOREIGN PATENT DOCUMENTS 2268223A 1/1994 (GB) .

* cited by examiner

*Primary Examiner*—Robert J. Sandy
(74) *Attorney, Agent, or Firm*—John Pietrangelo

(57) ABSTRACT

A method and apparatus for securing the ends of one or more cables is disclosed. These methods and apparatuses may be used, for example, to secure pleasure craft, for example, surfboards, wind surfboards, canoes or kayaks, for storage or transportation. The methods and apparatuses are characterized by a device having two channels which are hinged at a common end and to which include means for attaching the one or more cables. When the channels are rotated into engagement the one or more cables are not only tensioned but the means for attaching the cables are concealed from tampering or damage. The channels are preferably secured to each other and disengagement is prevented by means of a locking mechanism and a release mechanism. The release mechanism is preferably a push-button release mechanism which facilitates use of the device.

24 Claims, 11 Drawing Sheets

CLAMPING DEVICE FOR SECURING A CABLE

This application claims the benefit of U.S. Provisional Application No. 60/140,647 filed on Jun. 23, 1999.

INTRODUCTION AND BACKGROUND

Copending application Ser. No. 09/028,138 filed on Feb. 23, 1998 [agent ref. 100-02] (the disclosure of which are included by reference herein) disclose novel methods and apparatuses for securing one end of a cable to another end of cable, for example, to secure the ends of a cable for attaching a recreational craft, for example, a surfboard, to the hood or roof of a car or truck. The present invention is an improvement of the earlier inventions and includes an improved means of locking the devices disclosed in the earlier application to make these devices easier and safer to use and more appealing to the eye.

U.S. Application Ser. No. 09/028,138 discloses a device for securing a cable consisting of a set of u-shaped brackets or channels hinged at one end. The unhinged end of one bracket includes an adjustable device for securing the first end of a cable, for example, a plastic-covered, braided steel cable. The unhinged end of the second bracket also includes an adjustable arrangement for securing the second end of a cable. The characterizing feature of the invention disclosed in application Ser. No. 09/028,138 is that when the second bracket is rotated about the hinged end it engages the first bracket while concealing the devices used to secure the cable to the brackets. The brackets also include means for securing the engaged brackets, for example, a perforated tab for a padlock, to prevent the two brackets from being disengaged and the cable ends released.

The present invention provides for further improvements to the devices disclosed in application Ser. No. 09/028,138. For example, in one embodiment of the present invention, the means by which the first cable end is secured to the first bracket allows for ease of securing and tightening the first cable to the first bracket. The same means for securing and tightening is also more easily released when the second bracket is disengaged from the first bracket.

In addition, where the devices described in the above-referenced applications have been shown to provide a simple and effective means of securing the ends of cables, the locking mechanism described in those applications can be cumbersome and prone to tampering by others. The present invention overcomes these limitations of the devices disclosed in the above applications by introducing means of locking the devices incorporating a combination lock or lock-and-key arrangement, for example, a locking arrangement having a more user-friendly push-button release.

SUMMARY OF THE INVENTION

Similar to the device disclosed in 09/028,138, the present invention provides means for securing the ends of the same or separate cables in order to secure the cable or cables about an object, for example, a kayak or surfboard. The invention consists or comprises a first channel or u-shaped bracket having a first end and a second end and a second channel or u-shaped bracket having a first end and a second end. The first channel includes means for securing a first cable end adjacent the first end and the second channel also includes means for securing a second cable end. The second end of the first channel is rotatably hinged to the second end of the second channel such that when the second channel is rotated about its second end, the first end of the second channel engages the first end of the first channel. When the channels are engaged, the two means of securing the cable ends are concealed and access or tampering with these means is prevented.

One embodiment of the present invention comprises a device for securing one or more pleasure craft to prevent their theft or unauthorized use consisting of: a cable having a first end and a second end; a first u-shaped channel having a first end and a second end, having means for securing the first end of the cable adjacent to the second end of the channel; a second u-shaped channel having a first end pivotably connected to the first end of the first channel, a second end, and means for securing the second end of the cable at a point between the first end and the second end of the second channel; means for locking the first channel to the second channel after the second channel is rotated into engagement with the first channel; wherein said means for securing the first end of the cable to the first channel comprises or consists of a slidable device in the first channel which engages and secures the first end of the cable to the first channel and having means for connecting the slidable device to the second channel so that the slidable device engages and secures the first end of the cable when the second channel is rotated into engagement with the first channel.

The means for connecting the slidable device to the second channel comprises one or more rigid bars or rods. The slidable device preferably includes a circular, disk-like device about which the first cable end is drawn. The first channel preferably includes one or more wedge-shaped elements at the first end and the first end of the cable is retained between the slidable device and the one or more wedge-shaped elements. In one embodiment, the position of the slidable device is biased by a coil spring. In another embodiment the slidable device comprises a wedge shaped element and a rotatable circular element, about which the first end of the cable is drawn, and the wedge-shaped element and the circular element are mounted on a slidable plate. Furthermore, the one or more rigid bars which are connected to the second channel preferably are connected to the slidable plate.

A further embodiment of this invention includes an apparatus for securing a first cable end to a second cable end comprising or consisting of: a first u-shaped channel having a first end and a second end, the first channel having means for securing the first cable end adjacent to the second end of the channel; and a second u-shaped channel having a first end pivotably connected to the first end of the first channel, a second end, and means for securing the second cable end to the second channel; wherein the first and second channels include means for securing the first channel to the second channel after the second channel is rotated into engagement with the first channel and further wherein said second channel includes means for securing excess cable. The means for securing excess cable preferably consists of a rigid plate mounted on the second channel having one or more u-shaped recesses into which the excess cable can be inserted and retained.

Still Another embodiment of the present invention is an apparatus for securing a first cable end to a second cable end consisting of or comprising: a first u-shaped channel having a first end and a second end, the first channel having means for securing the first cable end adjacent to the second end of the channel; and a second u-shaped channel having a first end pivotably connected to the first end of the first channel, a second end, and means for securing the second cable end to the second channel; wherein the first and second channels include means for securing the first channel to the second channel after the second channel is rotated into engagement with the first channel and said first channel includes a threaded pin rigidly mounted to said first channel and said means for securing the first cable end to the second end of the first channel consists of at least one rotatable, threaded device rotatable about said threaded pin; and further wherein said threaded device includes means of retaining excess cable. The means for retaining excess cable preferably consists of or comprises one or more u-shaped recesses in the nut-like device into which the excess cable can be inserted.

Another embodiment of this invention comprises a device for securing a first cable end to a second cable end, consisting of: a first u-shaped channel having a first end and a second end, and having means for securing the first cable end adjacent to the second end of the channel; a second u-shaped channel having a first end pivotably connected to the first end of the first channel, a second end, and means for securing the second end of the cable at a point between the first end and the second end of the second channel; and means for securing the first channel to the second channel after the second channel is rotated into engagement with the first channel; wherein said means for securing the first channel to the second channel comprises a locking device which prevents separation of the first channel from the second channel.

The locking device is preferably combination-type locking device having human-readable indicia, for example, numbers or letters. The locking device may also be a lock-and-key type locking device. The cable-securing device preferably includes a release mechanism for releasing the locking device so that the first channel and second channel can be separated and the cable ends can be freed when the combination is input or the key turned. The release mechanism preferably includes a push button which, when depressed, releases a mechanism which disengages the means for retaining the first channel to the second channel. That is, after the combination is input or the key is turned and the push button is depressed, the channels can be separated and the cable ends released.

It is to be understood that the term "cable" can refer to any form of tensile member, for example, natural fiber or synthetic fiber rope, chord, or strap; or metal chain or metal cable, or the like. The cable is preferably one that provides at least some degree of security from breakage or theft, for example, it is not easily cut by conventional means. For example, one preferred cable is one consisting of braided metal wire, e.g., braided steel wire, enclosed in a wear-resistant plastic cover. This cover, or other means of preventing abrasion of the surface of the craft or support, is particularly preferred in areas where the cable bears against the craft or support. The cable ends secured by this invention may be the ends of the same cable or the ends of separate cables.

The present invention also includes a method of securing a first cable end to a second cable end of one or more cables by using a device consisting of a first u-shaped channel having a first end and a second end, the first channel having means for securing the first cable end adjacent to the second end, the first channel further including a pin rigidly mounted to said first channel adjacent to the second end of the first channel; a second u-shaped channel having a first end pivotably connected to the first end of the first channel, a second end, means for securing the second cable end to the second channel, and means for attaching excess cable; and means for securing the first channel to the second channel after the second channel is rotated into engagement with the first channel, said method consisting of the following steps: a) attaching the second cable end to the second channel; b) attaching the first cable end to the second end of the first channel and tensioning the first cable end such that excess cable protrudes out of the device; c) rotating the first channel into engagement with the second channel; d) securing the first channel to the second channel; and e) attaching the excess cable to the means for attaching excess cable.

The present invention also includes an apparatus for securing a first cable end to a second cable end consisting or comprising: a first u-shaped channel having a first end and a second end, the first channel having means for securing the first cable end adjacent to the second end of the channel; a second u-shaped channel having a first end pivotably connected to the first end of the first channel, a second end, and means for securing the second cable end to the second channel; means for securing the first channel to the second channel when the second channel is rotated into engagement with the first channel; wherein said means for securing the first channel to the second channel comprises a lock mechanism and a push-button release mechanism. This device preferably includes at least one rigid member mounted on the first channel and extending into the second channel which engages the release mechanism. This rigid member may consists of circular pin or a threaded device mounted on a threaded pin secured to the first channel. Preferably, the means for securing the first cable in the first channel comprises a threaded device and a plate mounted below the threaded device which can be used to clamp down on the cable end. This threaded device which clamps down on the cable may comprise the same rigid member which engages the release mechanism. Furthermore, as will be described below, the push-button release mechanism typically comprises a series of levers and linkages that engage the rigid member. The locking mechanism may be a combination-type lock mechanism or a key-type lock mechanism.

Another embodiment of this invention comprises a method for securing a first cable end to a second cable end using a device having a first u-shaped channel, having a first end and a second end, and means for securing the first cable end adjacent to the second end of the channel; a second u-shaped channel having a first end pivotably connected to the first end of the first channel, a second end, and means for securing the second cable end to the second channel; and a lock mechanism and a push-button release mechanism for securing the first channel to the second channel when the second channel is rotated into engagement with the first channel; comprising: (a) attaching the second cable end to the second channel; (b) inserting the first cable end into the cable securing means in the first channel; (c) drawing the first cable end through the cable securing means in the first channel to increase the tension in the first cable end; (d) rotating the second channel into engagement with the first channel while increasing the tension in the fist cable end and the second cable end; and (e) during or shortly after (d), engaging the push-button release mechanism to secure the first channel to the second channel and prevent the unauthorized separation of the channels and the release of the cable ends.

The means for securing the first cable end to the first channel preferably comprises a threaded device which mounts to a threaded pin and compresses the first cable end, as described earlier. When having such a device, the invention preferably further comprises: (f) practiced between (c) and (d), tightening the threaded device about the pin to compress the first cable end. The invention also may include (g) aligning the threaded device with the pushbutton release mechanism prior to (e).

The present invention provides an improved means of securing the ends of one or more cables so that the one or more cables to secure an object, preferably a pleasure craft, such as a kayak, canoe, skis, surfboard, snowboard, or windsurfboard or the like. These and other embodiments of this invention will become more apparent upon review of the following drawings and the attached claims.

DETAILED DESCRIPTION OF THE FIGURES

Figure 1:
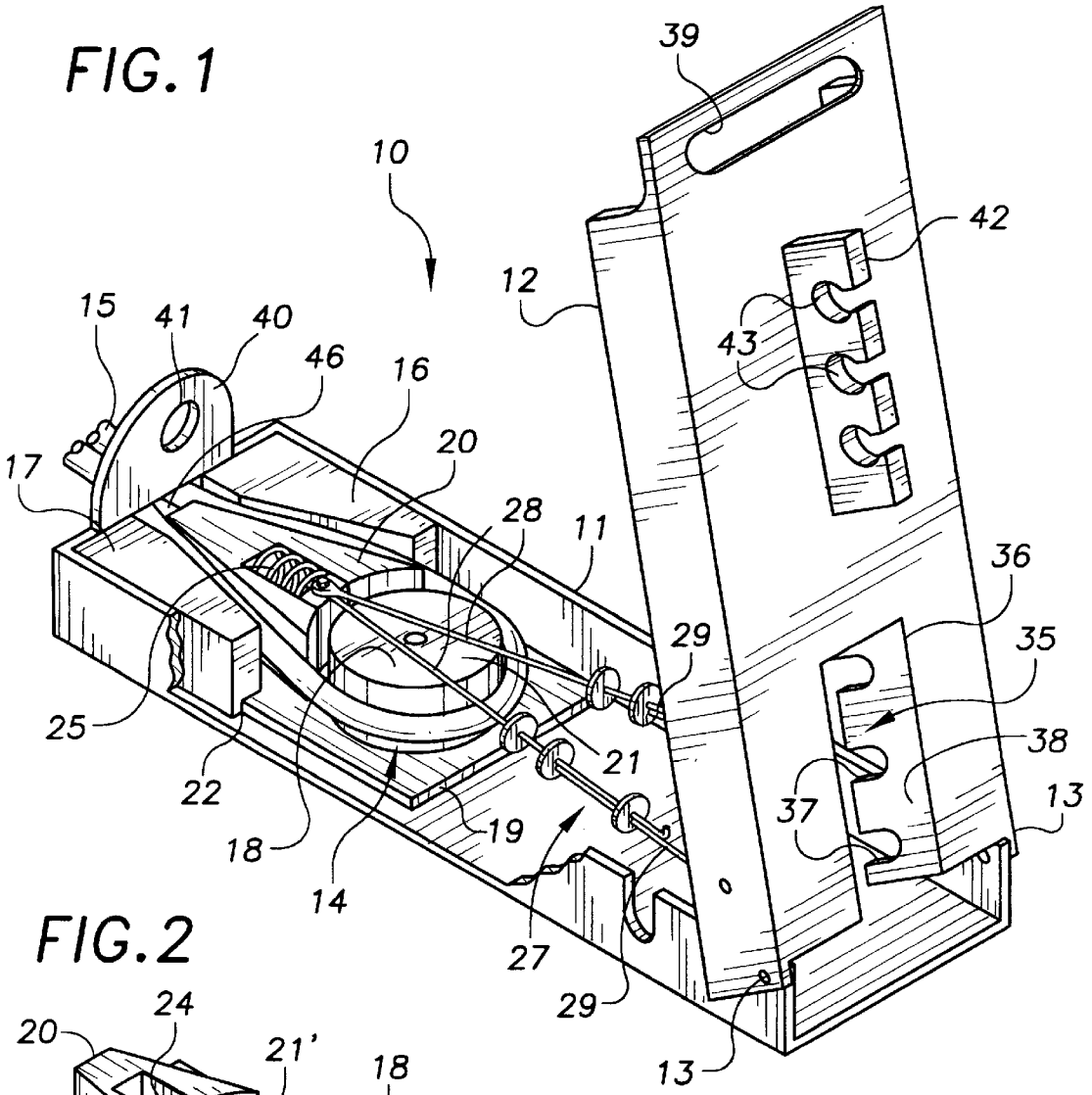
FIG. 1 illustrates an isometric view of one embodiment of the present invention.

FIG. 1 illustrates an isometric view of the present invention 10 in which some of the device has been removed to clarify the invention. Similar to the device shown in copending U.S. application Ser. No. 09/028,138, the device 10 includes a first u-shaped channel 11 and a second u-shaped channel 12. Channels 11 and 12 may be fabricated from commercially available channels or tubing (for example, a rectangular tube cut in half) or may be fabricated or formed from metal plate, preferably stainless steel plate, by forming or welding or other machining or fabrication processes. The two channels are hinged at 13 such that the second channel can rotate about the hinged end. The width of the second channel 12 is preferably larger than the width of the first channel so that when the second channel 12 is rotated into engagement with the first channel 11, the second channel 12 covers and conceals the first channel 11.

The first channel 11 includes means 14 for securing a cable 15. The means 14 includes a set of rigid members or blocks 16 and 17 that are secured to channel 11, for example, by welding. These blocks 16, 17 form a wedge shaped cavity through which the cable 15 passes as it engages means 14. Means 14 also includes a slidable device 18 (more clearly shown in FIG. 2) consisting or comprising a rectangular flat plate 19, a v-shaped wedge piece 20, and a circular disk 21. The wedge piece 20 and the disk 21 are attached to the flat plate 19, and the flat plate 19 engages slots in blocks 16,17 (shown at 22) such that the slidable device 18 slidably engages the slots in blocks 16, 17 in the direction shown by double arrow 23. Channel 11 also includes opening 46 for passing the cable 15 into the channel so that the cable can be engaged with retaining device 14 and then excess cable can pass out of channel 11.

Figure 3:
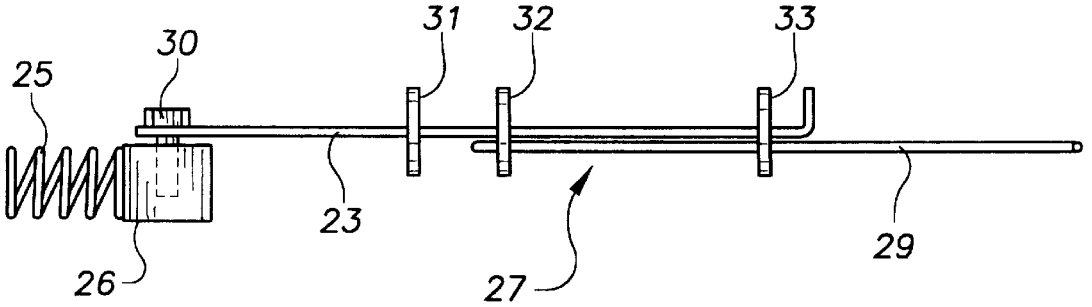
FIG. 3 illustrates a detail of another component shown in FIG. 1.

The v-shaped wedge piece 20 includes a cavity 24 for accepting a spring and plunger 26 (see FIG. 3). The wedge piece 20 is shaped similar to blocks 16,17 such that the outer surfaces of wedge 20 and the inside surfaces of blocks 16,17 act to capture and retain the cable 15 that passes between them. The outer surface of wedge 20 and the inside surfaces of blocks 16,17 form an angle of about 30 to 70 degrees with the axis of the channel 11, preferably an angle of about 40 to 60 degrees. The spring 25 is preferably attached to either wedge 20 or plunger 26, but spring 25 may not be attached at either end.

The disk 21 may be rigidly fixed to plate 19 or it may rotate about a central pin 21' which is fixed to plate 19. Disk 21 may also have a grove on its perimeter similar to a pulley or sheave to accept and retain the cable 15.

The interaction of the slidable device 18 having a wedge 20 and disk 21 with the cable end 15 provides an advantageous feature of the present invention. Specifically, when tension is created in cable end 15, for example during installation or under loading during use, the tension in the cable exerts a load on the disk 21 which is transferred to the wedge 20 and to the cable end 15. That is, this invention is self-clamping: tension created in the cable end 15 provides compression between the wedge 20 and the blocks 16, 17 to provide a clamping load on the cable 15.

Plunger 26 is connected to channel 12 by means 27 (again, see FIG. 3 for clarity) such that when channel 12 is rotated about the hinged end at 13, the plunger 26 is deflected against the spring 25 and the spring 25 in cavity 24 imposes a load on the v-shaped wedge 20. This spring load compresses the wedge 20 against the cable 15 such that the cable is wedged between wedge 20 and blocks 16,17. The means 27 may be one or more rigid rods or bars, for example rods 28 and 29 shown in FIG. 3. Rod 28 is attached to plunger 26, preferably rotatably attached to allow some freedom for the rod to rotate, for example, by means of the screw 30. Though a set of single rods may extend from plunger 26 to the channel 12 adjacent the hinged connection 13, in a preferred embodiment, two or more rods or bars 28 and 29 cooperate by means of stops 31, 32, and 33. These stops are shown as circular disks, but any form of physical obstruction to sliding movement may be used. Stop 31 is rigidly attached to rod 28. Stops 32 and 33 are rigidly attached to rod 29 but are slidably attached to rod 28 by means of through holes. The curved end 34 of rod 28 also acts to detain the movement of rod 29 when stop 33 impinges the end 34. The rods or bars 28 and 29 are allowed to move relative to each other until the stops are encountered and then the force exerted on one rod is transmitted to the other rod. This permits some amount of free movement or "play" in the movement of channel 12 without imposing a load on spring 25, wedge 20, and cable 15.

Channel 12 also includes features that are disclosed in copending application Ser. No. 09/028,138. For example, channel 12 includes means 35 for adjustably attaching a cable having a T-shaped end. As shown in copending application Ser. No. 09/028,138, the arms of a T-shaped end of a cable pass through the opening 36 in channel 11 and engage the opposite u-shaped openings 37 in side plates 38. The tension in the cable can be adjusted by appropriately engaging the arms of the T-shaped end in different sets of opposing u-shaped openings 37 (only one set of unshaped openings is shown in FIG. 1).

Channel 12 also includes an elongated slot 39 in the end of the channel opposite the hinged end 13. When the channel 12 is rotatably engaged with channel 11, the slot 39 engages the corresponding perforated tab 40 in channel 11, having through hole 41. The tab 40 and hole 41 are so designed to accept a locking device such as a conventional padlock.

Also, according to this invention the channel 12 includes a plate 42 positioned perpendicular to the top surface of channel 12 and having one or more, preferably two or more, u-shaped openings 43. These openings 43 are designed to retain any excess length of cable 15 that protrudes beyond the attachment device 14 and opening 46. The unshaped openings 43 are designed to be slightly less in diameter than the diameter of cable 15, in particular, a plastic covered cable, so that the cable can be inserted into two or more of the openings 43 and retained in openings 43 during transport or storage.

Figure 4:
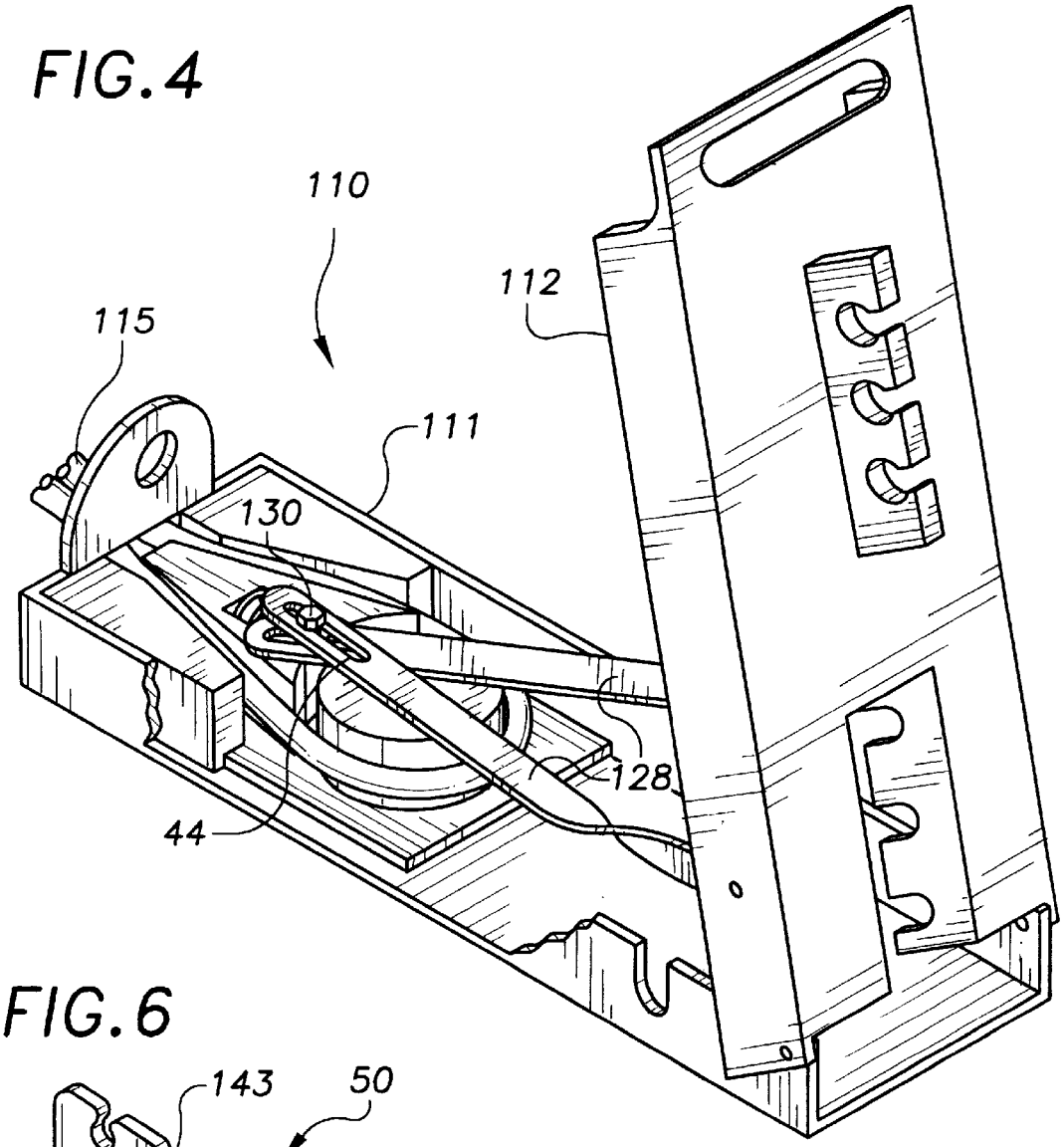
FIG. 4 illustrates an isometric view of a second embodiment of the present invention.
Figure 5:
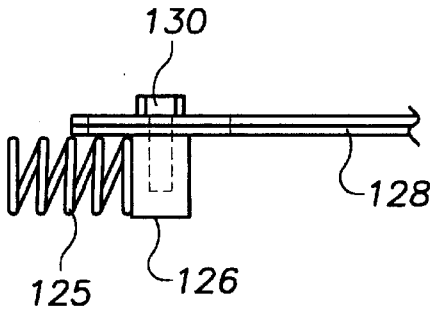
FIG. 5 illustrates a detail of a component shown in FIG. 4.

FIG. 4 illustrates another embodiment of the present invention which is very similar to the embodiment shown in FIG. 1. In the embodiment shown in FIG. 4, a device 110 having channels 111 and 112 for retaining cable 115 is similar to device 10 having channels 11 and 12. Rods or bars 28, 29 of FIG. 1 are replaced by bars 128. Bars 128, typically steel bars with a rectangular cross section, are used to attach the channel 112 to the plunger 126 which deflects spring 125 (similar to spring 25), as shown in FIG. 5.

The operation of device 10 (110) will be described with respect to FIG. 1. The order of operation is not critical to the invention. First, a T-shaped bar of cable (not shown) is inserted into opening 15 and the arms of the are engaged with a set of unshaped openings 37 in plates 38. Then the cable 15 is inserted into the opening 46; passed between one of the passages between blocks 16, 17 and wedge 20; passed about disk 21; then passed between the other passage between blocks 16, 17 and wedge 20; and then passed out of opening 46. The free end of cable 15 can then be drawn taunt around the disk 21 by pulling on cable 15. The channel 12 is then rotated about hinged end 13 so that it engages channel 11. In so doing, the rods 28, 29 (or bars 128 of FIG. 4) are compressed by the rotation of channel 12 and deflect the plunger 26 (126) against the spring 25 (125). The spring 25 (125) deflects the v-shaped wedge 20 so that the wedge 20 compresses the cable 15 between the outer surface of wedge 20 and the inside surfaces of blocks 16, 17. The resiliency of the spring 25 (125) provides for some relief in the clamping force on the cable 15, thus, the cable is not crimped between the wedge 20 and blocks 16, 17, but the stiffness of the spring 25 (125) is so chosen so that the cable is held and undesirable slippage prevented when the channel 12 is engaged with the channel 11. The engagement is secured by placing a locking device through hole 41, such as a padlock. The excess cable of cable 15 can be inserted into slots 43 to secure it for transport or storage.

Again, as described in copending application Ser. No. 09/028,138, the engagement of channels 11 and 12 also conceals the attaching mechanisms 14 and 35 so that neither can be tampered with while the channels are engaged.

Figure 6:
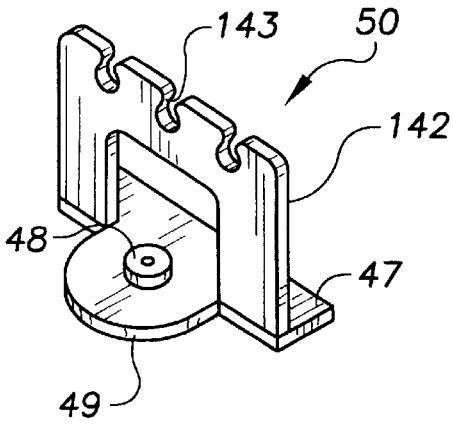
FIG. 6 is an isometric view of a threaded fastening device that can be used with the embodiments disclosed in copending U.S. application Ser. No. 09/028,138.

FIG. 6 illustrates a device used to provide the cable storage function of plate 42 and slots 43 in a clamping device as disclosed in copending application Ser. No. 09/028,138 (again, the disclosure of which is included by reference herein). As shown in FIGS. 4, 5 and 6 of application Ser. No. 09/028,138, one method of both retaining a cable in one channel and securing the two channels together is by means of a treaded nut-like device. The nut-like device functions to secure a cable end by compressing it beneath a plate and also provided means for securing the first channel to the second channel. That is, the nut-like device extends above the first channel and protrudes through the second channel and provides means for inserting a locking device, again, a padlock, such that the channels are secured together.

The device shown in FIG. 6 of this application is another nut-type device 50 that can be used in the embodiments shown in application Ser. No. 09/028,138. Device 50 comprises or consists of a vertical plate 142 attached to a horizontal plate 47 having a threaded hub 48 which can be threaded on to a bolt or stud attached to, for example, channel 111. In the embodiment shown, the vertical plate 142 and horizontal plate 47 are fabricated from a single plate by punching section 49 from a plate and bending the plate to form the horizontal plate 47, essentially perpendicular to plate 142. In the preferred embodiment shown, the cable retaining slots 143 provide a similar function to the slots 43 in plate 42 in FIG. 1. That is, these slots provide a location for attaching and retaining excess cable 15, that extends out of opening 46 in channel 11, for storage or transport.

Figure 7:
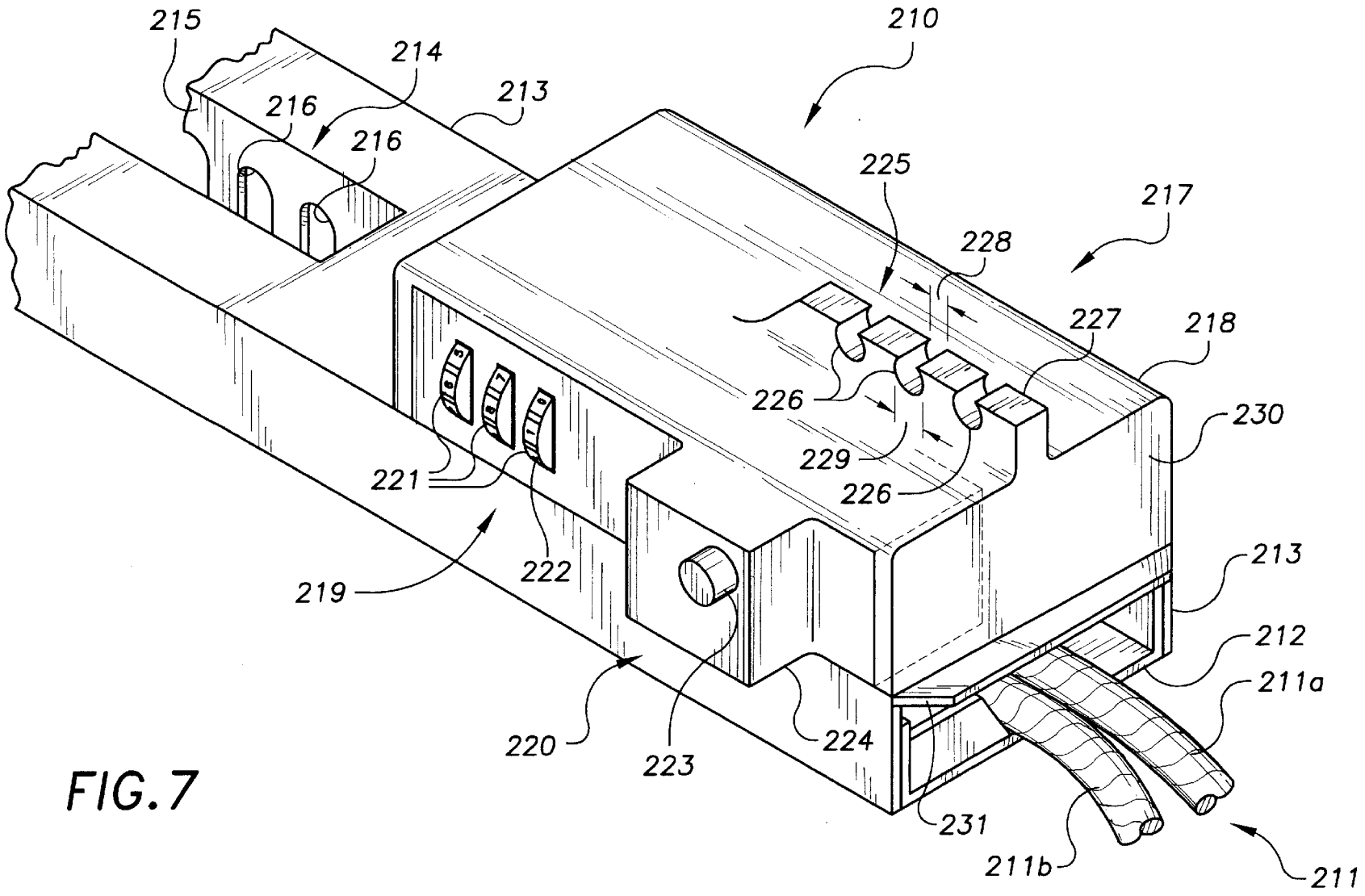
FIG. 7 is an isometric view of another embodiment of the present invention.

FIG. 7 illustrates a partial, isometric view of the preferred embodiment 210 of the present invention, marketed by the inventor under the trademark LASH & LOCK, for securing the first end of a cable (not shown) to a second end of a cable 211. For example, the device 210 can be used to secure a kayak or windsurfboard (not shown) to the top of a car or to the back of a truck (also not shown). The device consists of a first elongated channel 212, typically u-shaped in cross section, and a second elongated channel 213, also typically u-shaped in cross section. The present invention is not limited to u-shaped channels, but can be used with any appropriate elongated member which provides the function of the channels described. Channels 212 and 213 are hinged for rotatable engagement at one end (for example, in a fashion similar o the way channels 11 and 12 are hinged in FIG. 1) In FIG. 7, channels 212 and 213 are shown in the fully-rotatably-engaged position. The channel 213 is typically wider than the channel 212 so that when the channels are rotated into engagement, channel 213 encloses and covers channel 212 so that the mechanism for securing the cable end 211 is protected from damage or tampering.

Cable end 211 typically comprises a taunt end 211*a* which extends around the object or is attached to the object being secured, for example, a surfboard; and a loose end 211*b* which extends out of device 210 after engaging the means for securing the cable 211 to the device (for example, a mandrel-type post or pin, 21 shown in FIG. 1). The free-end 211*b* is typically drawn to snugly secure the object being retained.

At the opposite end of where the cable end 211 engages the device 210, the channel 213 typically includes means 214 for engaging and securing the second cable end (for example, as shown in FIG. 1 of application Ser. No. 09/028,138) to the device 210. In the embodiment shown in FIG. 7 (and more clearly shown in application Ser No. 09/028,138) the means 214 includes a rectangular cavity 215, the walls of which include pairs of opposite unshaped openings 216 for accepting, for example, the arms of t-shaped element attached to the end of the second cable end (not shown).

Figure 8:
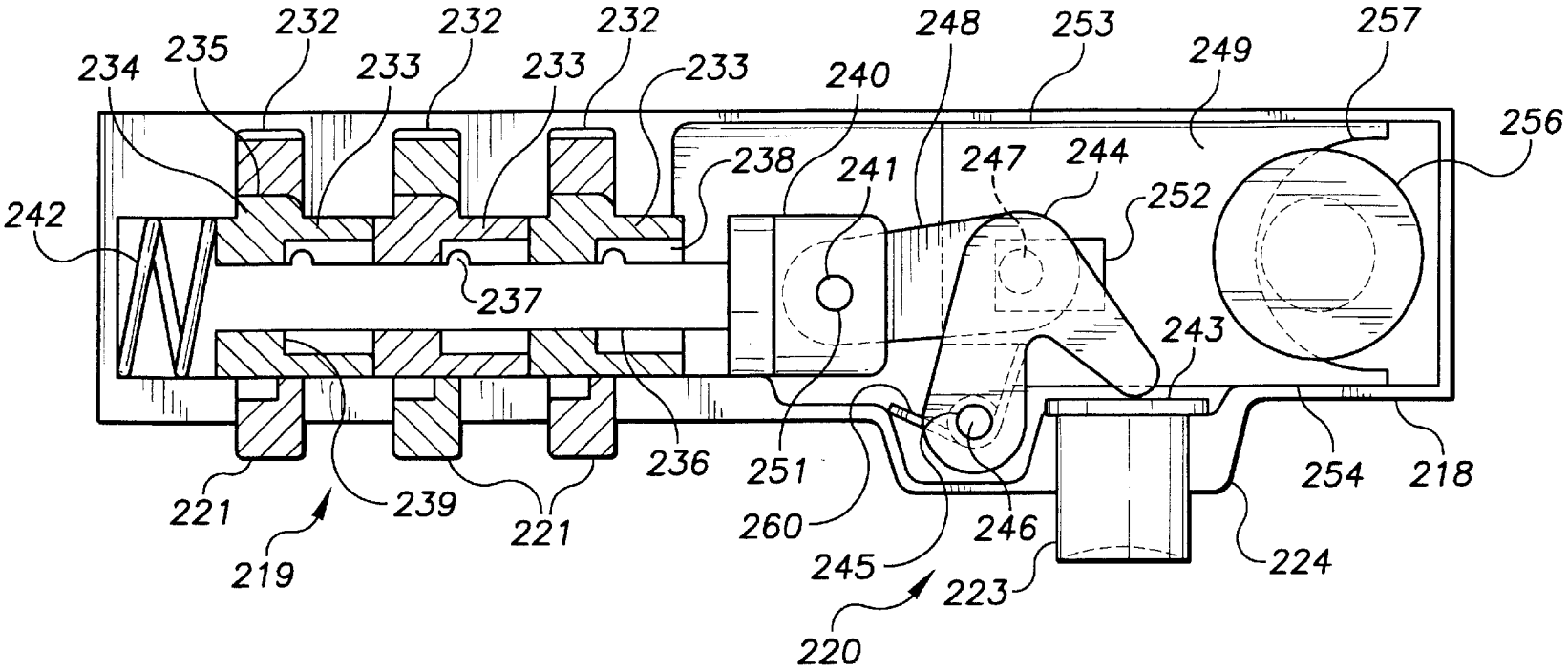
FIG. 8 is a top cross-sectional view of the preferred locking mechanism shown in FIG. 7.
Figure 9:
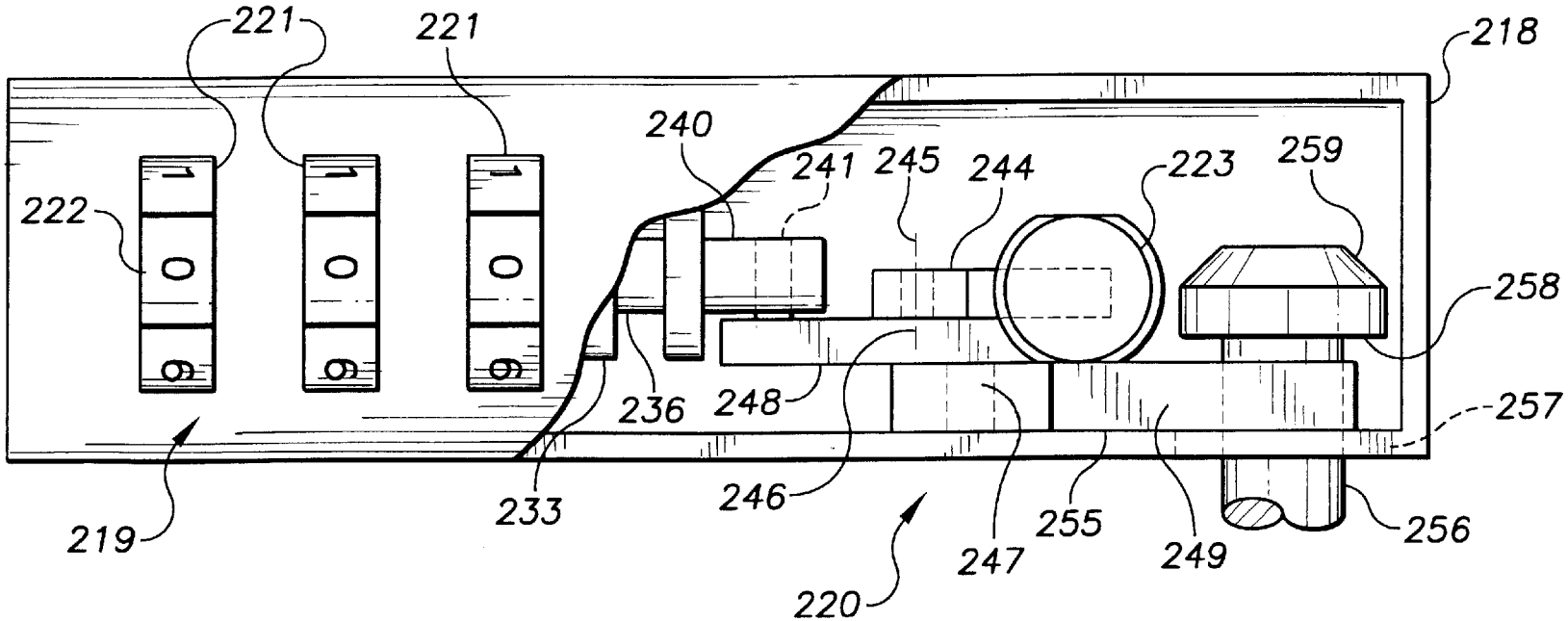
FIG. 9 is side view of the preferred locking mechanism shown in FIG. 7, with partial removal of the housing for clarity of illustration.

According to the present invention, the device 210 includes a locking mechanism 217, attached to channel 213, comprising a housing 218, a combination-lock mechanism 219, and a release mechanism 220. In the embodiment shown, the combination lock mechanism 219 consists of three rotatable wheels 221 having human-readable indicia 222, for example, numbers or letters. The wheels 221 are preferably mounted on the side of the housing 218 as shown, but it is understood that these wheels may be located anywhere it is convenient, for example, these wheels may be located and accessible on the top of housing 218. Though three wheels 221 are shown for inputting a sequence of numbers, it is understood that one or more wheels may be used, or some other form of conventional combination lock input may be used. For example, if desired, a single rotatable dial, for example, as is typical for a combination pad lock, may be located on the top of the housing 218. But according to the present invention, for ease of access to the combination mechanism and for ease of attaching the cable ends, the wheels 221 are preferably located on the side of the housing 218. Detailed illustrations of combination lock mechanism 219 are shown in FIGS. 8 and 9.

The release mechanism 220 is preferably a push-button release mechanism having a button 223 mounted in a boss 224 in the housing 218. It is to be understood that other types of release mechanisms may be used for mechanism 220, for example, mechanical levers or electro-mechanical devices. Detailed illustrations of release mechanism 220 are shown in FIGS. 8 and 9.

The locking device 210 also preferably includes means 225 for securing the loose, free end 211*b* of cable end 211. In the embodiment shown in FIG. 7, this means comprises at least one, preferably a plurality of, u-shaped opening 226 located in a rectangular block 227 positioned on the top of housing 218. These u-shaped openings preferably have a neck width 228 and a width 229 such that the cable end 211*a* can be snugly inserted and wound through one or more openings to retain the cable after securing the taunt cable end 211*a* to the device 210. Though 3 u-shape openings 226 are shown in FIG. 7 and these openings are located on the top of housing 218, it is understood that any number of openings may be used and that these openings may be located wherever convenient on housing 218 or on channel 213. For example, the means 225 for retaining the loose cable end 211*b* may also be located on the face 230 of housing 218 or anywhere else where convenient. The openings 226 may also be rectangular or square in shape.

In a preferred embodiment shown in FIG. 7, the channel 213 also preferably includes an extension or "lip" 231 that can be grasped by the user to more easily separate channel 213 from channel 212.

FIGS. 8 and 9 illustrate a top cross-sectional view and a side view, with the housing 218 partially removed, respectively, of the combination mechanism 219 and release mechanism 220 of housing 218 shown in FIG. 7. In one embodiment of this invention, the combination mechanism 219 includes one or more rotatable wheels 221 having human-readable indicia 222, for example, numbers or letters, on their periphery. These wheels are rotatable by the user to a pre-set sequence, as is conventional, to allow the release mechanism 220 to be deflected and the channels 212 and 213 separated. In the embodiment shown in FIGS. 8 and 9, the three wheels 221 have numerals 222 on their periphery, typically 0 to 9. The wheels 221 rotate in and are retained by circular recesses 232 in housing 218 and engage cylindrical, cup-shaped bushings 233. The wheels 221 typically engage the bushings 233 by means of protrusions 234 on the outer surface of bushings 233 which engage recesses 235 in the inner diameter of wheels 221. The bushings 233 slidably engage a rod or shaft 236. Each bushing 233 possesses an internal cavity 238 having a bottom surface 239. The rod 236 is physically connected to the release mechanism 220. The rod 236 typically includes protrusions 237 on its surface and a flanged end 240 having a through-hole 241. When the combination mechanism is in "locked" mode, the axial deflection of the rod 236 is prevented by the impingement of the protrusions 237 against the bottom surfaces 239 of the cavities 238 of bushings 233. When "unlocked" the protrusions 237 are aligned with slots (not shown) in bushings 233 and the rod 236 is allowed to axially deflect. The axial deflections of the bushings 233 and the rod 236 are biased in the direction of the release mechanism 220 by a coil spring 242. The mechanism 219 including wheels 221, bushings 233, and rod 236 is so arranged that when the pre-set combination is set by the user, the rod 236 can be deflected by activating the release mechanism 220. Otherwise, deflection of the rod 236 and activation of the release mechanism 220 is prevented.

Figure 10A:
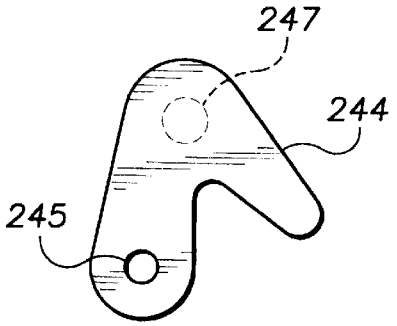
FIGS. 10A, 10B, 11A, 11B, 12A, and 12B are detailed views of the linkages shown in FIGS. 8 and 9.
Figure 10B:
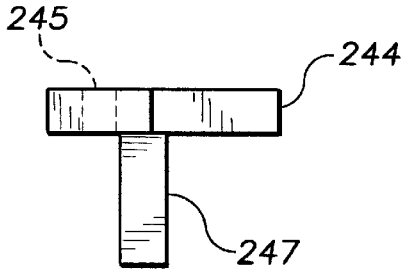
Figure 11A:
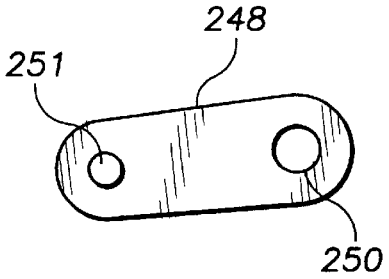
Figure 11B:
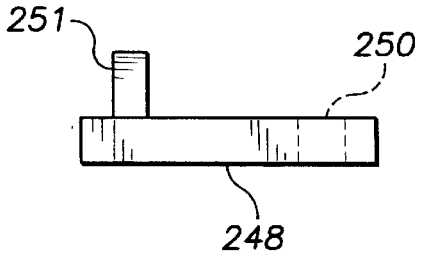
Figure 12A:
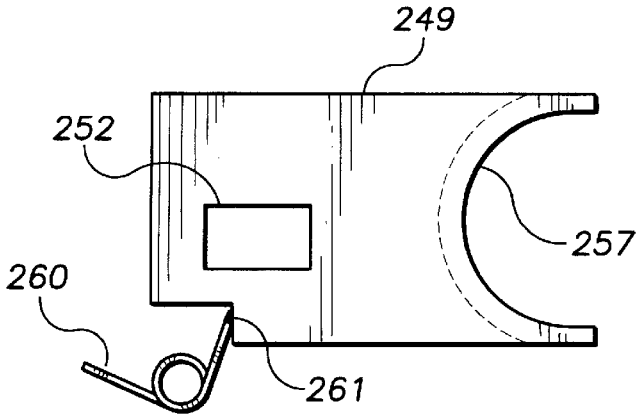
Figure 12B:
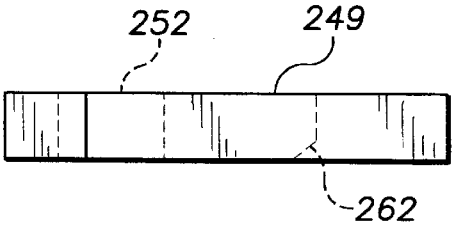

In the embodiment shown in FIGS. 8 and 9, the release mechanism is activated by depressing the button 223. As shown most clearly in FIG. 8, the bottom surface 243 of cylindrical button 223 contacts one arm of the cam/linkage 244. (A detail of linkage 244 appears in FIGS. 10A and 10B.) The cam/linkage 244, having a through-hole 245, rotates about a stationary pin 246 positioned in housing 218. Cam/linkage 244 also includes a pin 247 which engages both linkage 248 and sliding plate 249.

Details of linkage 248 and plate 249 appear in FIGS. 11A, 11B, 12A, and 12B. Linkage 248 has a through-hole 250 which engages the pin 247 of cam/linkage 244 and a pin 251 which engages through-hole 241 of rod 236. Pin 247 of cam/linkage 244 also engages slot 252 of plate 249. Plate 249 slidably engages the internal surfaces 253, 254, and 255 of housing 218 (see FIGS. 8 and 9). Plate 249 also engages stationary pin 256, which is rigidly mounted to the lower channel 212, by means of a semi-circular cavity 257. The leading surface of cavity 257 preferably includes a chamfer 262 to facilitate the sliding of plate 249 along housing surface 255. Pin 256 passes through housing 218 via circular opening 257 and includes a shoulder 258 which impinges upon the plate 249 if the release mechanism 220 is not activated. Pin 256 preferably also includes a chamfer 259 to facilitate insertion of pin 256 into hole 257. The position of plate 249 is preferably biased by coil spring 260 mounted on rigid pin 246 so that the plate engages pin 256 when the release mechanism 220 is not activated. Plate 249 also preferably includes a cut-out 261 for receiving the spring 260 (see FIG. 12A).

According to the present invention, see FIGS. 8 and 9, when the preset combination is set on wheels 221 such that rod 236 can axially deflect toward spring 242 when button 223 is depressed, the upper channel 213 can be disengaged from the lower channel 212 so that the first cable end 211 and the second cable end (not shown) can be released. When the button 223 is depressed, the bottom surface 243 of the button impinges upon and deflects cam/linkage 244. When cam/linkage 244 rotates about pin 246, pin 247 of cam/linkage 244 deflects linkage 248 via hole 250 in linkage 248. Linkage 248 via pin 251 deflects rod 236 via hole 241. Again, rod 236 can deflect since the pre-set combination input to wheels 221 permits the protrusions 237 to align with the slots (not shown) in bushings 233. At the same time, pin 247 of cam/linkage 244 also engages and deflects plate 249 via slot 252. This axial deflection of plate 249 away from pin 256 disengages the semi-circular opening 257 of plate 249 from pin 256 such that pin 256 can pass through hole 257. As a result, locking mechanism 220 and channel 213 can be disengaged from channel 212.

Figure 2:
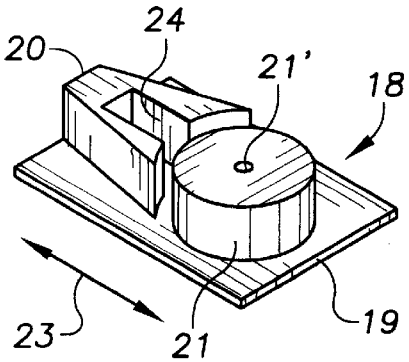
FIG. 2 illustrates an isometric detail view of one of the sliding component shown in FIG. 1.
Figure 13:
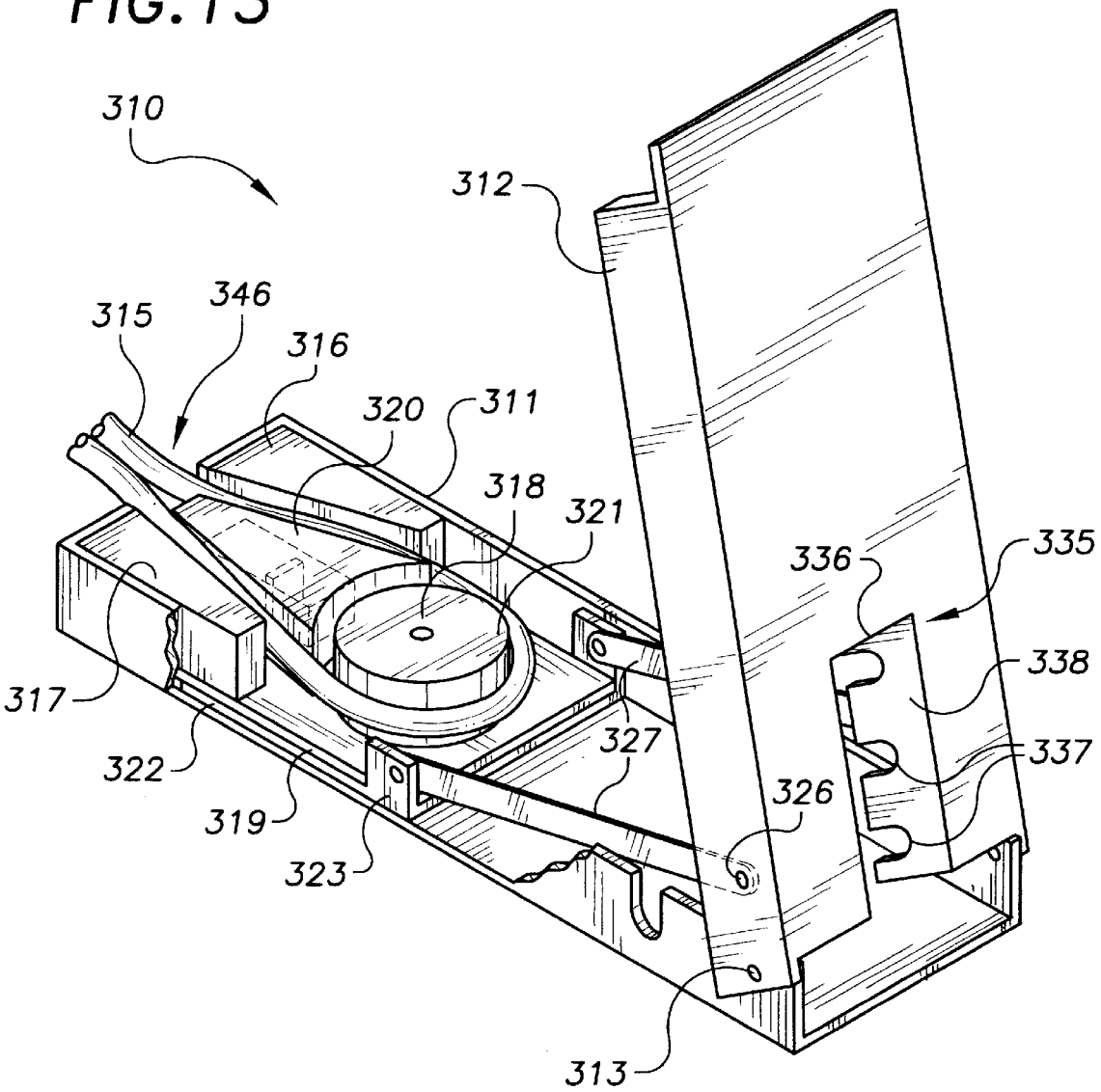
FIG. 13 is an isometric view, with partial removal of the housing for clarity, of another embodiment of the invention.

Another embodiment of the invention, similar to the devices shown in FIGS. 1 and 2, is shown in FIG. 13. FIG. 13 illustrates an isometric view of the present invention 310 in which some of the device has been removed to clarify the invention. Similar to the device shown in copending U.S. application Ser. No. 09/028,138, the device 310 includes a first u-shaped channel 311 and a second unshaped channel 312. Channels 311 and 312 may be fabricated from commercially available channels or tubing (for example, a rectangular tube cut in half) or may be fabricated or formed from metal plate, preferably stainless steel plate, by forming or welding or other machining or fabrication processes. The two channels are hinged at 313 such that the second channel 312 can rotate about the hinged end. The width of the second channel 312 is preferably larger than the width of the first channel 311 so that when the second channel 312 is rotated into engagement with the first channel 311, the second channel 312 covers and conceals the first channel 311.

The first channel 311 includes means 314 for securing a cable 315 which is similar to the means 14 shown in FIG. 1. The means 314 includes a set of rigid members or blocks 316 and 317 that are secured to channel 311, for example, by welding or screws. These blocks 316, 317 form a wedge-shaped cavity through which the cable 315 passes as it engages means 314. Means 314 also includes a slidable device 318 (the components of which are more clearly shown in FIG. 15) consisting or comprising a rectangular flat plate 319, a v-shaped wedge piece 320, and a circular disk 321. The wedge piece 320 and the disk 321 are attached to the flat plate 319, and the flat plate 319 slides under the stationary blocks 316,317 such that the slidable device 318 slidably engages the slots in blocks 316, 317. Plate 319 is also slidably mounted on plate 322 having vertical tabs 323. Channel 311 also includes opening 346 for passing the cable 315 into the channel so that the cable can be engaged with retaining device 318 and excess cable can pass out of channel 311.

Figure 14:
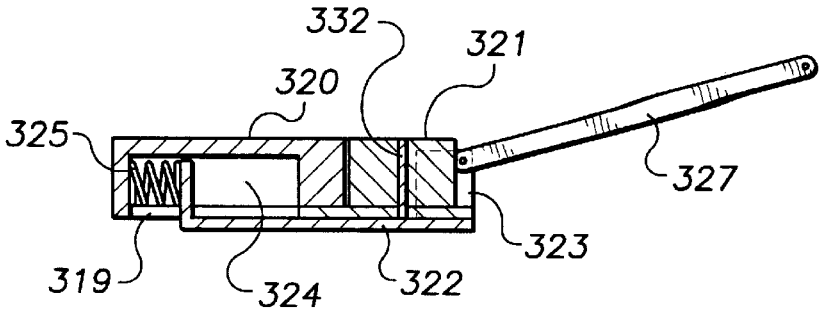
FIG. 14 is an elevation view, partially in cross section of some of the elements of FIG. 13.
Figure 15:
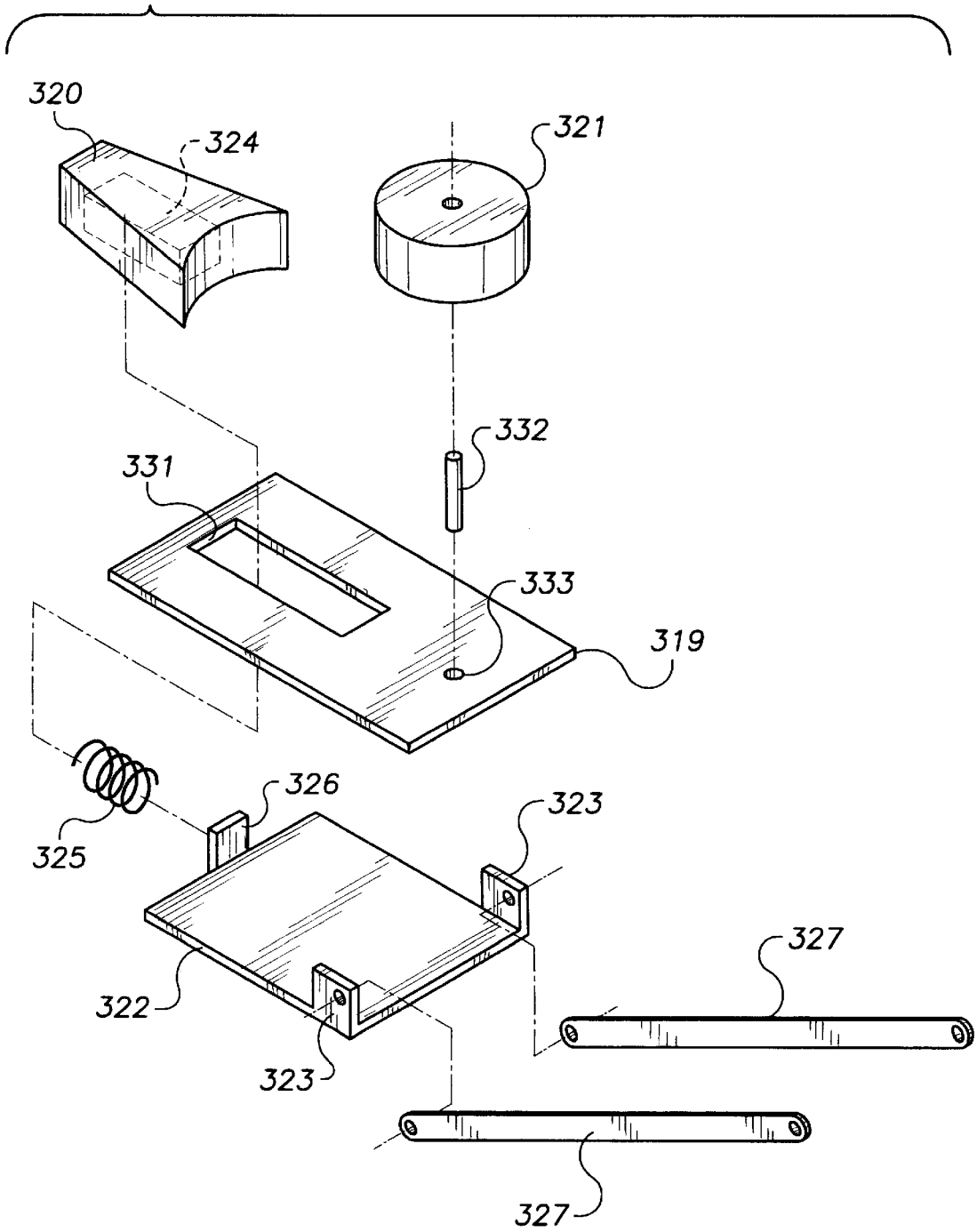
FIG. 15 is an exploded view of some of the elements shown in FIGS. 13 and 14.

As shown in FIG. 14, the v-shaped wedge piece 320 includes a cavity 324 for accepting a spring 325 and which is depressed by a vertical tab 326 (see FIG. 15). The wedge piece 320 is shaped similar to blocks 316,317 such that the outer surfaces of wedge 320 and the inside surfaces of blocks 316,317 act to capture and retain the cable 315 that passes between them. The outer surface of wedge 320 and the inside surfaces of blocks 316,317 form an angle of about 30 to 70 degrees with the axis of the channel 311, preferably an angle of about 40 to 60 degrees. The spring 325 is preferably captured in cavity 324 by the plate 322.

The disk 321 may be rigidly fixed to plate 319 or it may rotate about a central pin which is fixed to plate 319. Disk 321 may also have a grove on its perimeter similar to a pulley or sheave to accept and retain the cable 315.

Plate 322 is connected to channel 312 by means of rods or bars 327. Bars 327 are preferably pivotably connected to the vertical tabs 323 of plate 322 and pivotably connected to channel 312 at 326 such that when channel 312 is rotated about the pivotable connection 313, the vertical tab 326 of plate 322 is deflected against the spring 325. The spring 325 in cavity 324 imposes a load on the v-shaped wedge 320 and deflects slidable device 318, including plate 319 and disk 321. This deflection compresses the wedge 320 against the cable 315 such that the cable is wedged between wedge 320 and blocks 316, 317. The bars 327 may be one or more rigid rods or bars.

Channel 312 also includes features that are disclosed in copending application Ser. No. 09/028,138 (again, the disclosure of which is included by reference herein). For example, as discussed above with respect to FIG. 1, channel 312 includes means 335 for adjustably attaching a cable having a T-shaped end. As shown in copending application Ser. No. 09/028,138, the arms of a T-shaped end of a cable pass through the opening 336 in channel 312 and engage the opposite u-shaped openings 337 in side plates 338. The tension in the cable (not shown) can be adjusted by appropriately engaging the arms of the T-shaped end in different sets of opposing u-shaped openings 337 (only one set of u-shaped openings is shown in FIG. 13 due to the view chosen).

Channels 311 and 312 in FIG. 13 may also includes an elongated slot 39 and perforated vertical tab 40, as shown in FIG. 1, to secure the channels 311 and 312 when rotated into engagement. Channel 312 may also include the cable retainer 42 shown in FIG. 1.

FIG. 15 shows an exploded view of the components that compose the slidable device 318 shown in FIG. 13. The wedge-shaped element 320 is rigidly mounted on plate 319, for example, by welding or threaded fastener, such that the cavity for holding spring 325 is aligned with the slot 331 in plate 319. The spring 325 is positioned in cavity 324 of wedge 320. The disk 321 may be fixed, again, for example, by welding or threaded fastener, or rotatably mounted to plate 319. If the disk 321 is fixed to plate 319, it may be integral with wedge 320. If the disk 321 is rotatable it is preferably rotates about a rigid pin 332 mounted to plate 319, for example, in hole 333. The assembly comprising wedge 320, spring 325, disk 321, pin 332, and plate 319 is slidably mounted on plate 322 such that tab 326 passed through slot 331 and into cavity 324 and impinges against spring 325.

Though not shown in these figures, the device shown in FIG. 13 may also include combination lock mechanisms shown and described earlier in FIGS. 7 through 9 and the mechanisms shown and described below in FIGS. 16 through 23.

Figure 18:
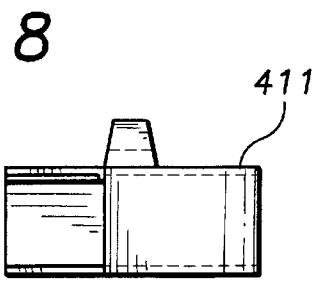
FIG. 18 is a side elevation view of the device shown in FIG. 16.
Figure 16:
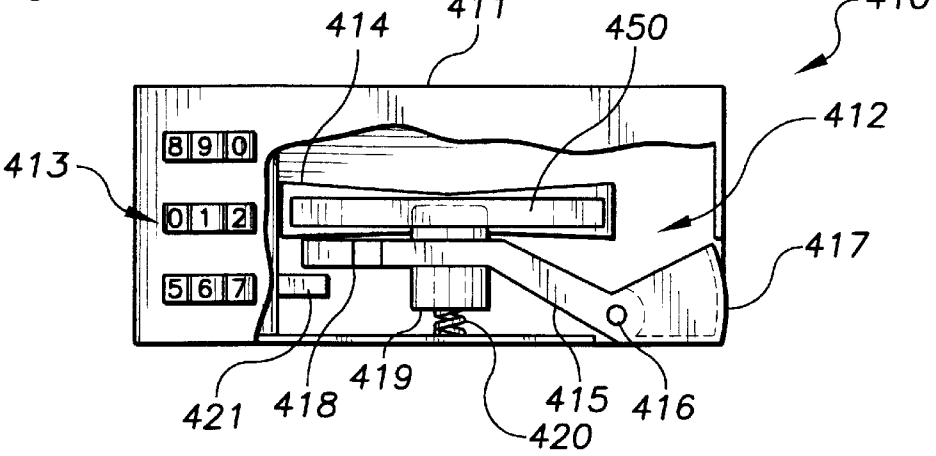
FIG. 16 is plan view, with partial removal of the housing for clarity, of the another locking mechanism.
Figure 17:
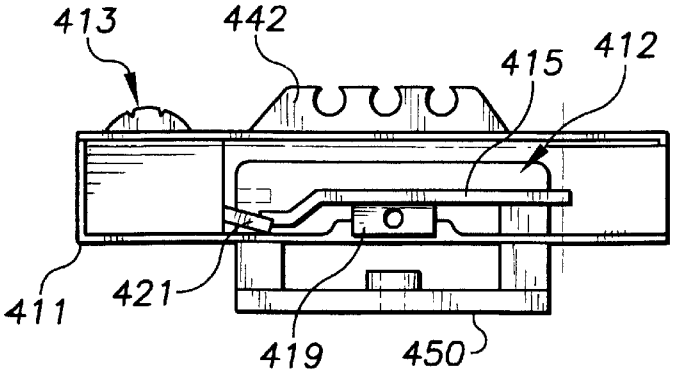
FIG. 17 is an elevation view, in cross section, of the device shown in FIG. 16.

Another combination lock mechanism that can be used, for example, to secure channels 11 and 12 of FIG. 1 or channels 311 and 312 of FIG. 13 is shown in FIG. 16, 17 and 18. FIG. 16 illustrates a plan view of a combination-type locking mechanism 410 that can be mounted to the top of channel 12 of FIG. 1 or channel 312 of FIG. 13 to securely retain the two channels and prevent unauthorized release of the cable the channels retain. This locking mechanism can also be used for the device disclosed in co-pending application Ser. No. 09/028,138 (again, the disclosure of which is incorporated by reference herein). Part of the device housing of mechanism 410 is removed to facilitate the following discussion.

Locking mechanism 410 includes a housing 411, a release mechanism 412 and a combination lock mechanism 413. The release mechanism 412 engages and disengages, as desired, a through hole of threaded, nut-like device 450 (similar to threaded device 50 shown in FIG. 6) that rotatably mounts to a threaded pin in the lower channel. For example, device 450 can be threaded onto a rigid threaded pin mounted channel 11 in FIG. 1 or channel 311 in FIG. 13, or most preferably to a threaded pin in the lower channel disclosed in co-pending application Ser. No. 09/028,138. The features of the threaded device 450 are most clearly illustrated in FIG. 19. The vertical extension of device 450 passes through a slotted hole in housing 414 to engage the release mechanism 412.

The release mechanism 412 comprises a uniquely designed pivoted lever 415. This lever 415, more clearly illustrated in FIGS. 21 and 22, pivots about pin 416 which is rigidly mounted in housing 411. Lever 415 includes a push button end 417 and a engagement end 418. The engagement end 418 of lever 415 engages pin 419 which engages the through hole 451 (see FIG. 19) of threaded device 450. Pin 419 is biased into engagement with device 450 by means of spring 420, preferably a coil spring mounted on a pin (not shown). The engagement end 418 of lever 415 also engages lever arm 421 of locking mechanism 413. (Lever arm 421 is most clearly shown in FIG. 23.) In the locked mode of locking mechanism 413, the lever arm 421 prevents the lever 415 from deflecting.

The relationship between lever arm 421 and lever 415 us more clearly illustrated in FIG. 17. As shown, when the arm 421 is in the downward "locked" position, the arm 421 engages the engagement end of lever 415 and prevents the deflection of arm 415. In the upward "unlocked" position of arm 421, shown in phantom in FIG. 17, the engagement end 418 of lever 415 does not engage arm 421 and the lever 415 is allowed to deflected when the push button end of lever 415 is deflected. When the combination mechanism is locked and the arm 421 is in the down position, the lever 415 cannot deflect and the pin 419 cannot disengage from the through hole 451 of threaded device 450 and the channels, for example, channels 11 and 12 of FIG. 1, cannot be disengaged.

As shown in FIG. 17, the device 410 may also include a cable retaining plate 442 similar to retainer 42 shown in FIG. 1.

Figure 19:
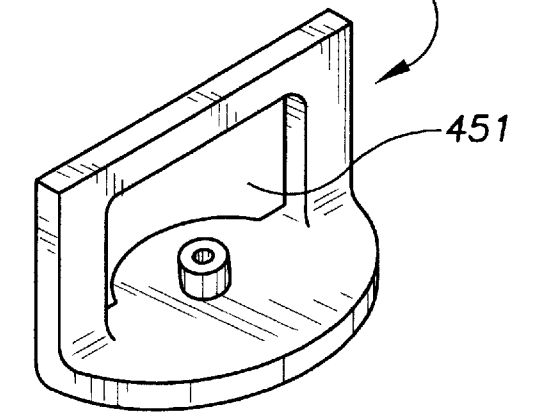

FIGS. 19 through 23 illustrate the general features of the components of the device shown in FIGS. 16 through 18. FIG. 19 illustrates a typical threaded, nut-like device 450 having a through hole 451 for engaging pin 419. Device 450 includes a threaded hub 452 which can thread upon a rigid pin (not shown) mounted in the lower channel of the devices described earlier. The device shown is fabricated from flat plate, but any suitable design which provides the desired function may be used.

Figure 20:
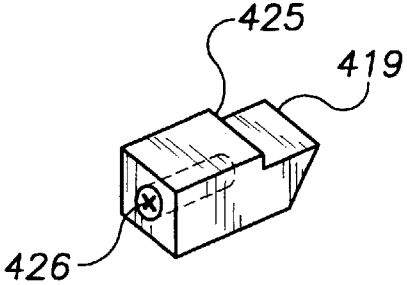
FIGS. 19 through 23 illustrate various components of the devices shown in FIGS. 16,17 and 18.

FIG. 20 illustrates an isometric view of the pin 419. Pin 419 typically includes a step 425 which engages the engagement end of lever 415. Pin 419 also preferably includes a blind hole 426 into which coil spring 420 may be inserted and retained. Though pin 419 is shown rectangular in cross section, it may also be round.

Figure 22:
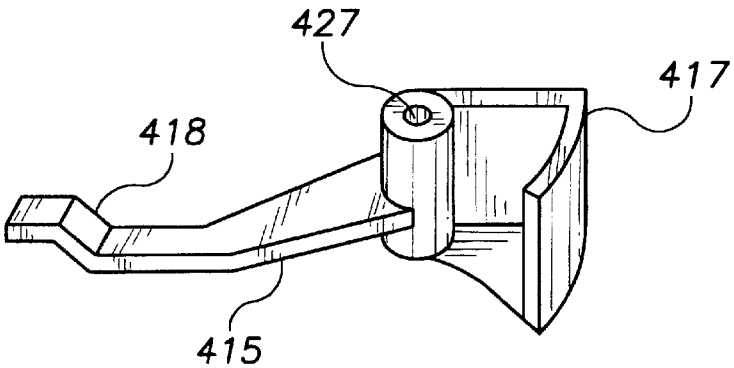
Figure 21:
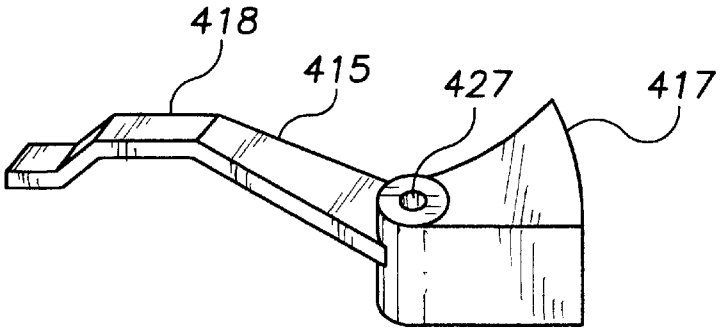

FIGS. 21 and 22 are front and rear isometric views of the lever 415. Again, the lever 415 includes a push button end 417 and an engagement end 418. Lever 415 also includes a through hole 427 which engages pin 416 (see FIG. 16).

Figure 23:
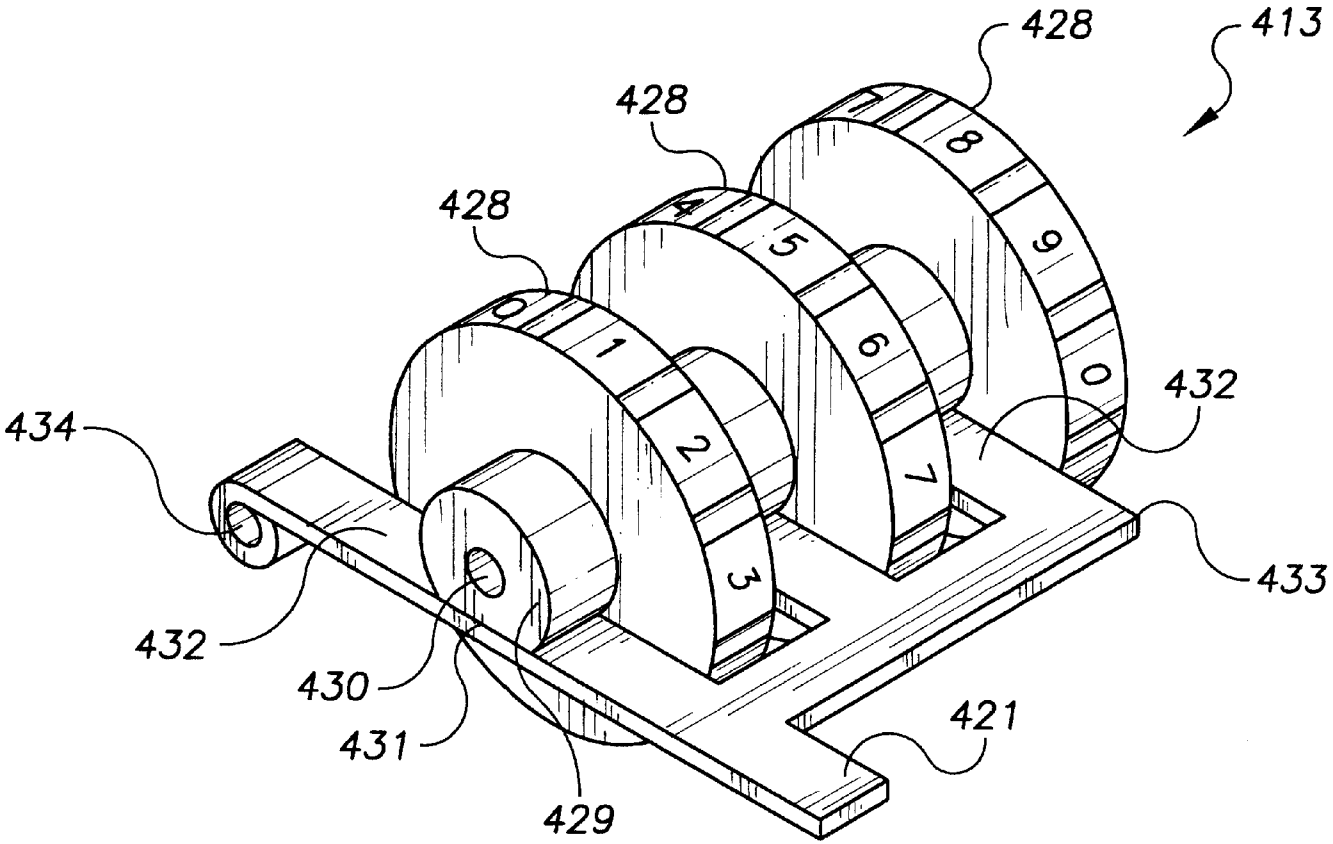

FIG. 23 illustrates an isometric view of the combination lock mechanism 413 shown in FIG. 16. In the embodiment shown, the lock mechanism 413 includes three rotatable combination wheels 428 mounted on a pin 430 and having peripheries bearing human readable indicia, that is, numbers or letters. Attached to each wheel and rotating with each wheel is a hub or cam 429. Each cam is general circular in shape but includes a flat land area 431. The surface of the cams 429 bear against the fingers 432 of the lever 433. Lever 433 is pivotably mounted at the end 434 of the fingers 432. The lever 433 and lever arm 421 are biased to the upward position by a spring not shown. When the combination wheels 428 are in the "locked" position, the rounded surfaces of the cams 429 bear against the fingers 432 and deflect the lever 433 about the ends 434. This deflects the lever arm 421 to the down position and, as shown in FIG. 17, prevents the deflection of lever 415 and the channels cannot be disengaged. In FIG. 23, the locking mechanism is shown in the "unlocked" when a predetermined combination is set on the combination wheels 428 such that the flat cam areas 431 bear against the fingers 432. This permits the deflection of lever 433 under the force of the spring (not shown) to deflect upward and, as shown in FIG. 17, disengage the lever 315 so that when the button end 417 of lever 415 is depressed the pin 419 can be disengaged from device 450 and the channels can be separated and the cable released.

As described above, the methods and devices of this invention provide means for securing the ends of one or more cables, for example, to prevent, the theft or unauthorized use of one or more pleasure craft while facilitating the act of securing and releasing the craft. While the invention has been described in connection with what is presently considered to be the most practical and preferred embodiment, it is to be understood that the invention is not to be limited to the disclosed embodiment, but on the contrary, is intended to cover various modifications and equivalent arrangements and methods included within the spirit and scope of the appended claims, and as broadly allowed by the prior art.

What is claimed is:

1. A device for securing one or more pleasure craft to prevent their theft or unauthorized use, the device comprising:

a cable having a first end and a second end;

a first u-shaped channel having a first end and a second end, having means for securing the first end of the cable adjacent to the second end of the channel; and a second u-shaped channel having a first end pivotably connected to the first end of the first channel, a second end, and means for securing the second end of the cable at a point between the first end and the second end of the second channel; and means for securing the first channel to the second channel after the second channel is rotated into engagement with the first channel;

wherein said means for securing the first end of the cable to the first channel consists of a slidable device in the first channel which engages and secures the first end of the cable to the first channel and having means for connecting the slidable device to the second channel so that the slidable device engages and secures the first end of the cable when the second channel is rotated into engagement with the first channel.

2. A device as in claim 1, wherein the means for connecting said slidable device to the second channel comprises one or more rigid bars or rods.

3. A device as in claim 2, wherein the slidable device includes a circular disk about which the first cable end is drawn.

4. A device as in claim 1, wherein said first channel includes stationary wedge-shaped elements at the second end of the first channel and the first end of the cable is retained between the slidable device and the wedge-shaped elements.

5. A device as in claim 1, wherein the position of the slidable device is biased by a coil spring.

6. A device as in claim 1, wherein said slidable device comprises a wedge shaped element and a rotatable circular element, about which the first end of the cable is drawn, mounted on a slidable plate.

7. A device as in claim 2, wherein said slidable device comprises a wedge shaped element and a rotatable circular element, about which the first end of the cable passes, mounted on a slidable plate and the one or more rigid bars are connected to the slidable plate.

8. An apparatus for securing a first cable end to a second cable end, the apparatus comprising:

a first u-shaped channel having a first end and a second end, the first channel having means for securing the first cable end adjacent to the second end of the channel; and a second u-shaped channel having a first end pivotably connected to the first end of the first channel, a second end, and means for securing the second cable end to the second channel;

wherein the first and second channels include means for securing the first channel to the second channel after the second channel is rotated into engagement with the first channel and said first channel includes a threaded pin rigidly mounted to said first channel and said means for securing the first cable end to the second end of the first channel comprises at least one rotatable, threaded device rotatable about said threaded pin.

9. An apparatus as in claim 8, wherein said rotatable threaded device includes means of retaining excess cable.

10. An apparatus as in claim 9, wherein said means for retaining excess cable comprises one or more u-shaped recesses in the rotatable threaded device into which the excess cable can be inserted.

11. An apparatus for securing a first cable end to a second cable end, the apparatus comprising:

a first u-shaped channel having a first end and a second end, the first channel having means for securing the first cable end adjacent to the second end of the channel; and a second u-shaped channel having a first end pivotably connected to the first end of the first channel, a second end, and means for securing the second cable end to the second channel;

means for securing the first channel to the second channel when the second channel is rotated into engagement with the first channel;

wherein said means for securing the first channel to the second channel comprises a lock mechanism and a push-button release mechanism.

12. An apparatus as recited in claim 11, further including a rigid member mounted on the first channel and extending into the second channel which engages the release mechanism.

13. An apparatus as recited in claim 12, wherein said rigid member is a circular pin.

14. An apparatus as recited in claim 12, wherein said rigid member is a threaded device mounted on a threaded pin secured to the first channel.

15. An apparatus as recited in claim 14, wherein the means for securing the first cable in the first channel comprises the threaded device and a plate mounted below the threaded device.

16. An apparatus as recited in claim 12, wherein the push-button release mechanism comprises a series of levers and linkages that engage the rigid member.

17. An apparatus as recited in claim 11, wherein said lock mechanism is a combination-type lock mechanism or a key-type lock mechanism.

18. A method for securing a first cable end to a second cable end using a device having a first a first u-shaped channel having end and a second end, the first channel having means for securing the first cable end adjacent to the second end of the channel; a second u-shaped channel having a first end pivotably connected to the first end of the first channel, a second end, and means for securing the second cable end to the second channel; and a lock mechanism and a push-button release mechanism for securing the first channel to the second channel when the second channel is rotated into engagement with the first channel; comprising:

(a) attaching the second cable end to the second channel;

(b) inserting the first cable end into the cable securing means in the first channel;

(c) drawing the first cable end through the cable securing means in the first channel to increase the tension in the first cable end;

(d) rotating the second channel into engagement with the first channel while increasing the tension in the first cable end and the second cable end; and (e) during or shortly after (d), engaging the push-button release mechanism to secure the first channel to the second channel and prevent the unauthorized separation of the channels and the release of the cable ends.

19. A method as recited in claim 18, wherein the means for securing the first cable end to the first channel comprises a threaded device which mounts to a threaded pin and compresses the first cable end, and further comprises: (f) practiced between (c) and (d), tightening the threaded device about the pin to compress the first cable end.

20. A method as recited in claim 18, further comprising: (g) aligning the threaded device with the push-button release mechanism prior to (e).

21. An apparatus as in claim 1, wherein the second channel includes means for retaining excess cable.

22. An apparatus as in claim 21, wherein the measn for retaining excess cable comprises one or more u-shaped recesses into which the excess cable can be inserted.

23. An apparatus as in claim 11, wherein the second channel includes means for retaining excess cable.

24. An apparatus as in claim 23, wherein the means for retaining excess cable comprises one or more u-shaped recesses into which the excess cable can be inserted.

* * * * *